United States Patent [19]

O'Brien

[11] Patent Number: 4,700,830

[45] Date of Patent: Oct. 20, 1987

[54] PAINT ROLLER AND HOSE CADDY ASSEMBLY

[75] Inventor: Lawrence B. O'Brien, Carmel, Ind.

[73] Assignee: Triune Automated Painting Systems, Carmel, Ind.

[21] Appl. No.: 811,112

[22] Filed: Dec. 19, 1985

[51] Int. Cl.[4] ..... B65D 83/00; B65D 85/02

[52] U.S. Cl. ..... 206/229; 15/257.06; 206/361; 220/85 D; 248/79; 248/113; 248/213.2; 248/310; 401/197

[58] Field of Search ..... 15/257 R, 257.06, 323, 15/230.11; 206/15.2, 209, 229, 361, 362; 220/85 D, 90; 248/75, 76, 79, 89, 90, 110, 111, 112, 128, 213.2, 310, 113; 401/188 R, 197

[56] References Cited

U.S. PATENT DOCUMENTS

| | | | |
|---|---|---|---|
| 986,660 | 3/1911 | Weathers | 248/110 |
| 2,646,808 | 7/1953 | Yenne | 206/209 |
| 2,685,100 | 8/1954 | Schaefer | 15/230.11 |
| 2,757,958 | 8/1956 | Bussey et al. | 248/79 |
| 3,288,306 | 11/1966 | Walters | 248/89 |
| 3,361,507 | 1/1968 | O'Neil | 206/361 |
| 3,536,187 | 10/1970 | Stafford | 206/361 |
| 3,576,045 | 4/1971 | Stafford | 15/257.06 |
| 4,253,716 | 3/1981 | Turner, Jr. | 248/79 |
| 4,424,011 | 1/1984 | O'Brien et al. | 401/197 |

*Primary Examiner*—Jimmy G. Foster
*Attorney, Agent, or Firm*—Woodard, Emhardt, Naughton, Moriarty & McNett

[57] ABSTRACT

A portable carrier for paint roller, handle, and hose assembly includes a base, a post, a roller pocket on the base, a roller handle receiver bracket on the post, a hook arrangement for attaching to a paint can, hose storage means on the bracket and base, and hose tying means.

13 Claims, 3 Drawing Figures

PAINT ROLLER AND HOSE CADDY ASSEMBLY

BACKGROUND OF THE INVENTION

This invention relates generally to painting apparatus, and more particularly to a device for holding and carrying a paint roller and associated hoses for a powered painting system.

A U.S. Pat. No. 4,424,011 discloses a powered painting apparatus in which paint is pumped from a five-gallon can through tubing into a roller assembly for painting walls and ceilings and the like. That apparatus includes a wheeled cart with a place thereon for the paint pump and controls, the five-gallon container of paint, and a paint roller storage compartment in the front of the cart. The paint roller could be placed temporarily in the compartment during a pause in painting. The compartment had a cover which could be closed until such time as the painter was ready to resume painting. The roller could be left in the compartment overnight without cleaning the roller and without having the paint dry in the roller, so then it could be returned to use whenever desired.

The apparatus disclosed in U.S. Pat. No. 4,424,011 worked well for the intended purpose, but it did require some space. Also, in view of the considerable size of the roller storage compartment which was useful for cleaning the roller, it could not keep an uncleaned roller in good operating condition for more than several days. The object of the present invention is to increase convenience, versatility, and improve performance of paint roller storage means.

SUMMARY OF THE INVENTION

Described briefly, according to a typical embodiment of the present invention, a paint roller storage device is in the form of a portable carrier for a paint roller and hose and includes a spine, a roller pocket on the spine, a roller handle receiver on the spine, a clip arrangement on the spine for attaching to a five-gallon can, a delivery hose storage frame, and hose tying means on the spine.

DESCRIPTION OF THE PREFERRED EMBODIMENT

Figure 1:
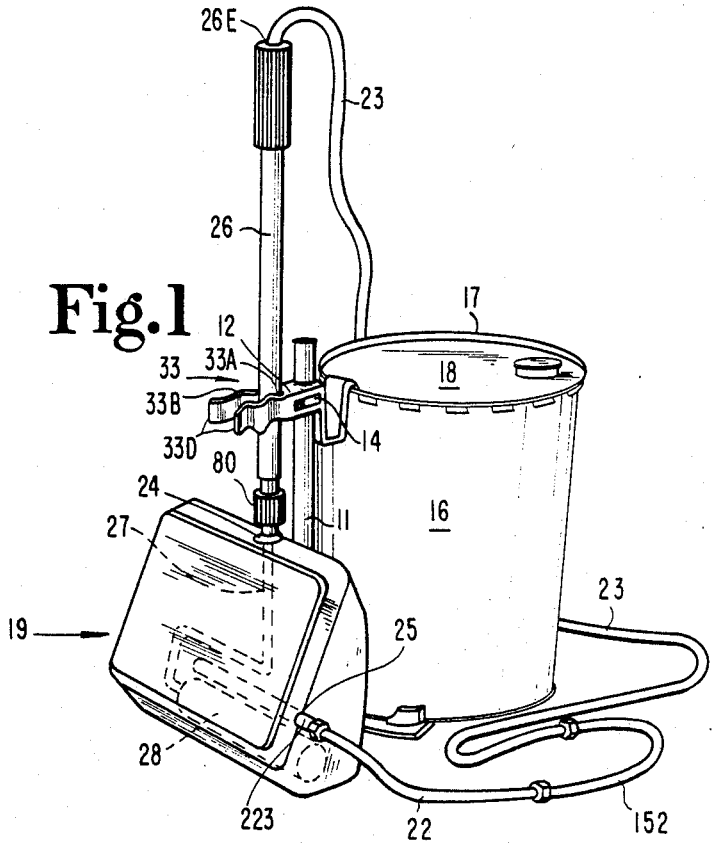
FIG. 1 is a frontal pictorial view of a paint roller caddy assembly according to a typical embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, a post 11 serves as a spine for the assembly. It has a bracket 12 near the top, and a base 13. The bracket 12 has a central aperture slidably receiving post 11, and a spring loaded cam lock inside gripping the post. The cam lock is releasable by pushing the lever 14 to enable sliding the bracket up and down on the post.

The base 13 is fixed to the post. It has a front portion 13F resting on the ground, a rear foot portion 13R resting on the ground, and an inverted U-shaped intermediate channel portion 13U between them. The rear foot portion has a pair of channels 13C thereon spaced apart and at the edges of a segment of a circle whose center is the center of a standard cylindrical five-gallon paint can 16. Channels 13C receive and locate the bottom edge bead of the can therein.

Bracket 12 has a hook 12H with a downturned end. If the roller caddy is being used with the paint can remaining covered with the lid securely in place (as is normally the case), the bracket is hooked around the bead 17 of the can lid 18. The downturned end is received in the shallow well 18W at the inside of the bead of the typical can lid. The cam lock will lock the bracket in place so that a secure attachment of the caddy to the can is achieved. If the lid is off the can, and the caddy is mounted to the can while painting, the downturned end of hook 12H is receivable inside the can at the upper edge of the can wall, to securely attach the caddy to the can.

To release the can from the caddy, the lever 14 is pushed while bracket 12 is manually pulled upward. A foot can be placed on the base top 13T, if desired, to hold the base in place on the floor while the bracket 12 is pulled upward with respect to the base 13, and thereby release the hook 12H from the inside wall of the lid (or the wall of the can in the case of an open paint can).

The roller receiver 19 is on the front foot portion 13F of base 13. It includes a pocket 20 with lid 21 hinged at 21H to swing down toward the floor when opened as indicated by the dashed line in FIG. 2. The receiver is of a size to closely fit the roller therein, allowing only enough room at the end of a nine inch roller, for example, to be just sufficient to get the handle inside the pocket. The pocket lid has a slot in the top with a split grommet 24 therein which will be received around the roller handle 27 when the lid is closed after the roller 28 is put in place in the pocket 20. It is desirable that the lid 21 and grommets fit snugly so that it is air tight, when closed.

Figure 2:
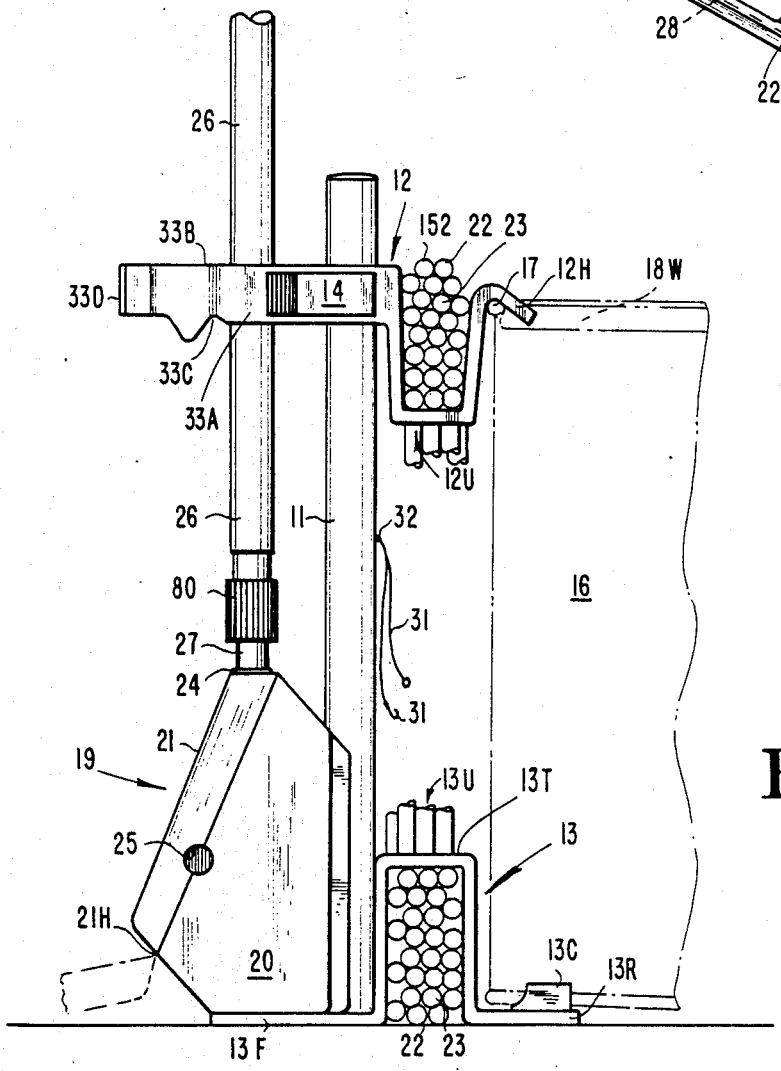
FIG. 2 is an enlarged side elevational view thereof.
Figure 3:
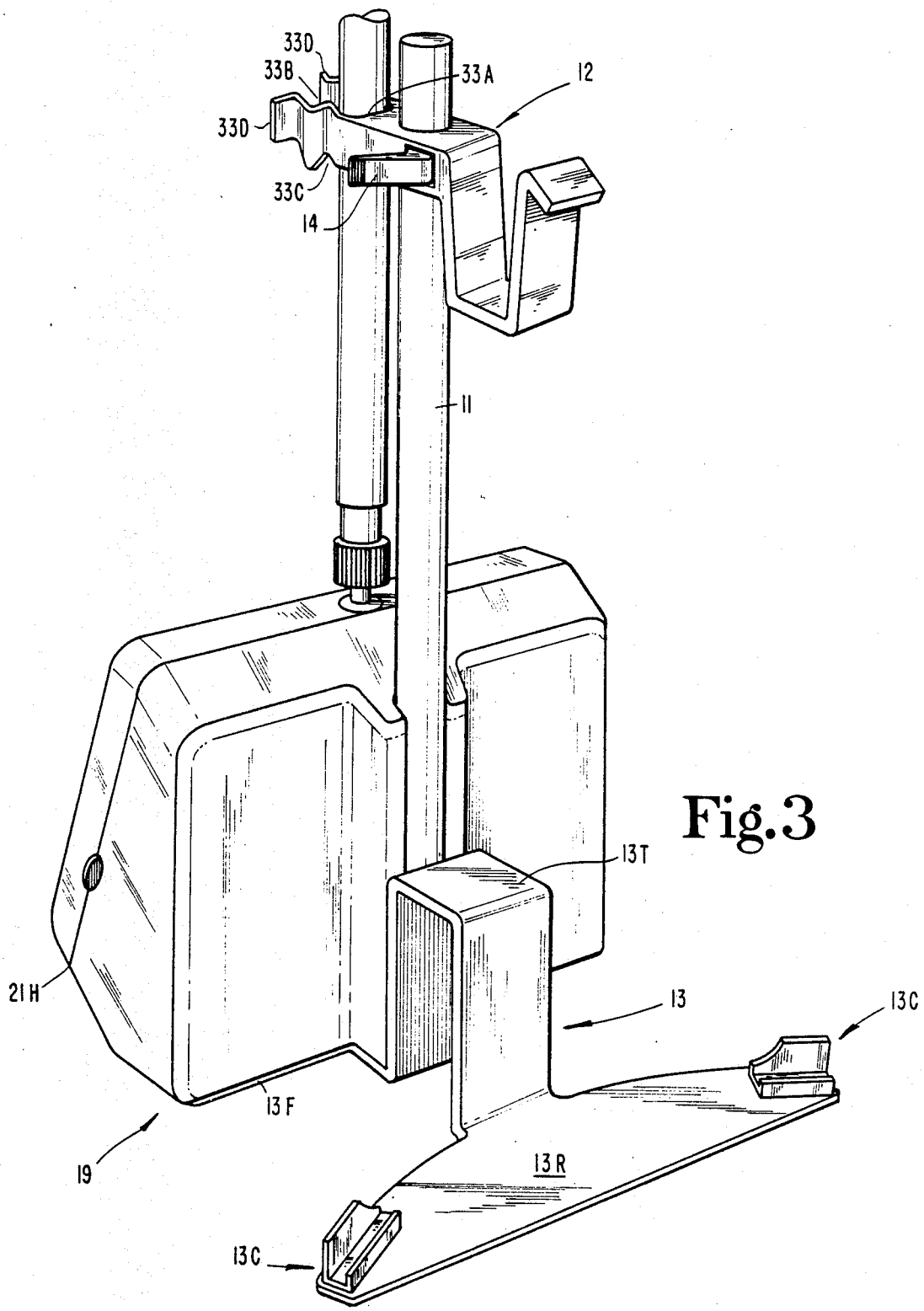
FIG. 3 is a further enlarged rear pictorial view.

In the context of this specification, reference numerals for roller handle, extension and hose are the same as in the above-mentioned patent, the disclosure of which is incorporated herein by reference. In FIG. 1, the roller handle 27 is attached to handle extension 26 by the coupling 80. The paint supply hose 23 extends out the end 26E of the extension 26. After removal of the paint can from the caddy assembly, the paint supply hose 23, still assembled to pump hose 152 and pump inlet hose 22, can be wrapped around the channel portions 13U of base 13 and 12U of bracket 12, respectively, as shown in FIG. 2. The pickup tube 223 is pulled out of the paint can, wiped off, and then stuck through the notch 25 in pocket 20 and lid 21 and it can rest on top of the roller 28. In order to keep the hose in place around the post 11, hose ties 31 are attached to the post 11 at 32. These can be plastic or rubber ties with hooks and eyes on them as shown, for example.

In order to keep the roller handle extension 26 in place, a spring clip yoke 33 is provided in the bracket 12. The extension 26 can be pushed in past the yoke entrance ends 33D and the outboard detent 33B and snapped into the inboard detent 33A of the spring clip yoke.

In use of the device, it is conveniently at hand, attached to the paint can. As mentioned above, the paint can usually will be used with the lid securely in place, and paint will be pumped out using the pickup tube inserted through a spud opening in the lid. During a pause in the painting, the caddy provides a convenient and tidy place for the painter to rest the roller. When there will be a prolonged pause in the painting, as overnight or over a weekend, the roller can be left there. If the painting has been completed, and if the painter does not intend to clean the roller at the job site, the roller can be simply placed in the pocket 20. The bracket 12 is raised enough to release the paint can. The roller handle extension is snapped into detent 33A of the clip 33. The lid cover 21 is closed and latched with a magnetic or other latching system. Then the paint can is removed. The hose assembly (including the pump portion 152 removed from the pump as disclosed in the aforementioned patent, and the inlet hose 22), is wrapped around the bracket and base 12 and 13, respectively, as shown in FIG. 2. The pickup tube is placed in the notch or through the hole 25 (if the lid 21 is closed immediately after putting the roller in the pocket). The hose ties can be wrapped around the hose and hooked together whereupon the unit can be picked up and carried away for storage wherever desired, or for cleaning at another site. The facts that one of the hose receivers is on the bracket 12, and the bracket can be adjusted lengthwise along the post, enable the painter, after removal of the paint can, to select the position on the post which enables the painter to most neatly and compactly wrap the hose around the base and bracket. This is particularly helpful where the wrapping includes not only the delivery hose, but also the inlet hose and the pump hose and associated fittings, all still assembled together.

If the intent is to clean the roller, the paint can is removed and may be replaced with a can having a drain rack and drain outlet and valve therein. Cleaning fluid can be placed in the can up to a level below the drain rack. Then the pick-up tube 223 can be placed in the can with its intake below the drain rack so that it picks up the cleaning fluid. Then the roller can be placed in the can on top of the drain rack. Then the pump is operated to run cleaning fluid through the roller and let it drain through the rack back into the can. The roller can be rolled along the rack during this procedure, if desired.

Other procedures can be adopted according to the experience and preferences of the painter. For example, it may be considered desirable to essentially fill an empty five-gallon paint can with cleaning fluid, insert a false bottom device, have the pick up tube above the false bottom so that it continually draws clean fluid from the can, whereas paint and heavier components can settle in the bottom as they are discharged from the roller immersed in the can as it is worked along the false bottom or up and down on the scrub board or is simply left in place in the can while the cleaning fluid is circulated through it. Clip 33 is useful to hold the handle or handle extension while the roller is left in place. For this purpose, the bracket 12 is turned about the post 26 through 180 degrees from the position shown in the drawings. The notch 33C is hooked onto the rim of the can in the same manner as was the hook 12H described above. Then the roller handle or extension is snapped into the outboard detent 33B where it will be properly held until the roller is to be moved or removed from the can. The detent 33B can also be used to hold the roller above the surface of any fluid in the can, to permit draining and dripping from the roller. This can be useful also to hold the roller while paint is pumped out of the system into the can of paint after painting and prior to cleaning the equipment.

When the cleaning is completed, the roller can be removed from the can and stored in the pocket 20. If it is desired to remove the roller cover from the roller, that can be done also at any time desired in the procedure or before the actual pumping of the fluid through the roller.

It can be seen that the assembly of the present invention could be placed on the cart disclosed in the above mentioned patent, in place of the caddy 226 that is shown in that patent. Thus it can be wheeled around when desired, or separated and removed completely (separate from the paint can, pump and controls) if the painter wants to take the paint delivery apparatus away from the site, such as might be the case for cleaning elsewhere than at the location of the painting work.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A paint roller caddy assembly comprising:

a post;

a paint roller receiver at said post;

a bracket on said post above said receiver;

a hose storage hook on said bracket for wrapping hose thereon; and paint can attachment means on said bracket to attach said assembly to a paint can.

2. The assembly of claim 1 wherein:

said bracket and said locator means are sized and spaced for attachment to a conventional five gallon cylindrical paint can.

3. The assembly of claim 1 wherein:

said paint can attachment means is a downturned end portion of said hook for reception in the well of a paint can lid to attach the assembly to a paint can with the lid in place covering the can.

4. A paint roller caddy assembly comprising:

a post;

a paint roller receiver at said post;

a bracket on said post above said receiver;

a hose storage hook on said bracket for wrapping hose thereon; and a post base secured to said post, and having hose storage means spaced from said hook;

said bracket being slidable along said post to change the distance between the hook and the hose storage means on the base.

5. The assembly of claim 4 wherein:

the hose storage means on said base is an inverted channel in the base, and the storage hook is a channel in the bracket.

6. The assembly of claim 5 wherein:

the channel in the base is the shape of an inverter U, and the channel in the bracket is U-shaped.

7. A paint roller caddy assembly comprising:

a post;

a paint roller receiver at said post;

a bracket on said post above said receiver;

a hose storage hook on said bracket for wrapping hose thereon;

the roller receiver including a pocket to fittingly receive a paint roller, said pocket having a front wall and a back wall, said post being at the back wall;

and said roller receiver pocket having a lid to close the pocket and cover the roller in the pocket and exclude air; and roller handle extension clip means on said bracket and including a yoke for reception of a roller handle extension therein.

8. The assembly of claim 7 and further comprising:

a can attached to said bracket.

9. A paint roller caddy assembly comprising:

a post;

a paint roller receiver at said post;

a bracket on said post above said receiver;

a hose storage hook on said bracket for wrapping hose thereon;

the roller receiver including a pocket to fittingly receive a paint roller, said pocket having a front wall and a back wall, said post being at the back wall;

and said roller receiver pocket having a lid to close the pocket and cover the roller in the pocket and exclude air;

said receiver pocket front wall having an upper margin near the bottom of said pocket, and said lid being hinged to said upper margin of the front wall of said receiver pocket to open forward and downward to admit the roller to said receiver.

10. A paint applicator caddy assembly comprising:

bracket and locator means for attachment to a paint can;

a paint applicator receiver attached to said locator means;

paint hose receiving and storage means on said bracket and locator means;

said bracket and locator means being arranged for wrapping hose from said bracket means to said locator means and being spatially adjustable to change the dimensions of the span of the hose wrapped around said bracket means and said locator means.

11. A paint applicator caddy assembly comprising:

bracket and locator means for attachment to a paint can;

a paint applicator receiver attached to said locator means;

paint hose receiving and storage means on said bracket and locator means;

said bracket and locator means including a clip for clipping onto a paint applicator handle to hold the handle in place during transit or storage of the assembly.

12. The assembly of claim 11 wherein:

said bracket and locator means include hooking means associated with said clip to hook onto the top of a paint can wall when the paint can is placed in said locator means, and hold the applicator handle in position adjacent a rim of the paint can.

13. The assembly of claim 12 wherein:

said means to hook onto a paint can are under the clip.

* * * * *